US008721107B2

(12) United States Patent
Cotzias

(10) Patent No.: US 8,721,107 B2
(45) Date of Patent: May 13, 2014

(54) METHOD AND APPARATUS FOR RETROFITTING AN OPEN BULB LIGHTING FIXTURE

(76) Inventor: Chris T. Cotzias, Grosse Pointe Park, MI (US)

( * ) Notice: Subject to any disclaimer, the term of this patent is extended or adjusted under 35 U.S.C. 154(b) by 139 days.

(21) Appl. No.: 13/441,321

(22) Filed: Apr. 6, 2012

(65) Prior Publication Data

US 2012/0257395 A1 Oct. 11, 2012

Related U.S. Application Data

(60) Provisional application No. 61/473,013, filed on Apr. 7, 2011.

(51) Int. Cl.
*F21V 3/00* (2006.01)
*F21V 1/00* (2006.01)
*F21V 15/00* (2006.01)

(52) U.S. Cl.
USPC ..... 362/147; 362/185; 362/576

(58) Field of Classification Search
USPC ..... 362/185, 576, 147
See application file for complete search history.

(56) References Cited

U.S. PATENT DOCUMENTS

| | | | | | |
|---|---|---|---|---|---|
| 794,458 | A | | 7/1905 | Gollatz | |
| 2,636,091 | A | | 4/1953 | Carter | |
| 3,056,035 | A | * | 9/1962 | Bernheim | 362/457 |
| 3,070,690 | A | | 12/1962 | Horn | |
| 3,234,342 | A | | 2/1966 | Murray | |
| 4,107,768 | A | | 8/1978 | Lemkin | |
| 4,428,032 | A | | 1/1984 | Workman | |
| 5,073,845 | A | * | 12/1991 | Aubrey | 362/650 |
| 5,546,291 | A | * | 8/1996 | Simes | 362/223 |
| 5,716,125 | A | * | 2/1998 | Aubrey | 362/260 |
| 5,717,179 | A | | 2/1998 | Meyer | |
| 6,099,144 | A | * | 8/2000 | Klaus | 362/263 |
| 6,866,399 | B2 | * | 3/2005 | Eaton, Jr. | 362/260 |
| 6,974,233 | B1 | * | 12/2005 | Aubrey | 362/294 |
| 7,461,964 | B1 | * | 12/2008 | Aubrey | 362/647 |

* cited by examiner

*Primary Examiner* — Mariceli Santiago
(74) *Attorney, Agent, or Firm* — Vincent Re PLLC

(57) ABSTRACT

An open bulb fixture is a lighting fixture presenting a light bulb exposed and unprotected to an area around the light bulb. A light cover is a transparent or translucent cover protecting a light bulb while permitting light from the light bulb to pass through the light cover to the area around the light bulb. A method for protecting an open bulb lighting fixture includes positioning a light cover to the open bulb fixture.

3 Claims, 7 Drawing Sheets

METHOD AND APPARATUS FOR RETROFITTING AN OPEN BULB LIGHTING FIXTURE

CROSS REFERENCE TO RELATED APPLICATIONS

This disclosure is claims the benefit of U.S. Provisional Application No. 61/473,013 filed on Apr. 7, 2011 which is hereby incorporated by reference.

TECHNICAL FIELD

This disclosure is related to retrofitting an unprotected light fixture with a protective cover.

BACKGROUND

The statements in this section merely provide background information related to the present disclosure. Accordingly, such statements are not intended to constitute an admission of prior art.

A building structure can include a lighting fixture to provide illumination within or around the structure. A lighting fixture is attached to a wall or ceiling surface and is electrically connected to the electrical wiring of the structure. Alternating current electrical power can be provided to the lighting fixture through the electrical connections.

Electrical connections from the electrical wiring of the structure can include three wire connections. A first wire, which in one exemplary configuration can be covered with a polymer insulator colored red or black, is a hot fixture wire. A second wire, which in one exemplary configuration can be covered with a polymer insulator colored white, is a neutral wire. A third wire, which in one exemplary configuration can be an exposed copper wire, is a grounding wire. Use of three wires to provide AC power to a light bulb is well known in the art. In some instances, two wires can be used, including the hot fixture wire and the neutral wire.

Incandescent light bulbs provide electrical power to a filament within a glass bulb. Additionally, high efficiency light bulbs such as halogen bulbs or compact fluorescent lamps are known in the art and can be powered through a connection to a light socket interface. Light bulbs can screw into a light socket interface, or light bulbs can include other methods to engage with the light socket interface, such as a two pin connector or other connectors known in the art.

SUMMARY

An open bulb fixture is a lighting fixture presenting a light bulb exposed and unprotected to an area around the light bulb. A light cover is a transparent or translucent cover protecting a light bulb while permitting light from the light bulb to pass through the light cover to the area around the light bulb. A method for protecting an open bulb lighting fixture includes positioning a light cover to the open bulb fixture.

BRIEF DESCRIPTION OF THE DRAWINGS

One or more embodiments will now be described, by way of example, with reference to the accompanying drawings, in which.

DETAILED DESCRIPTION

Figure 1:
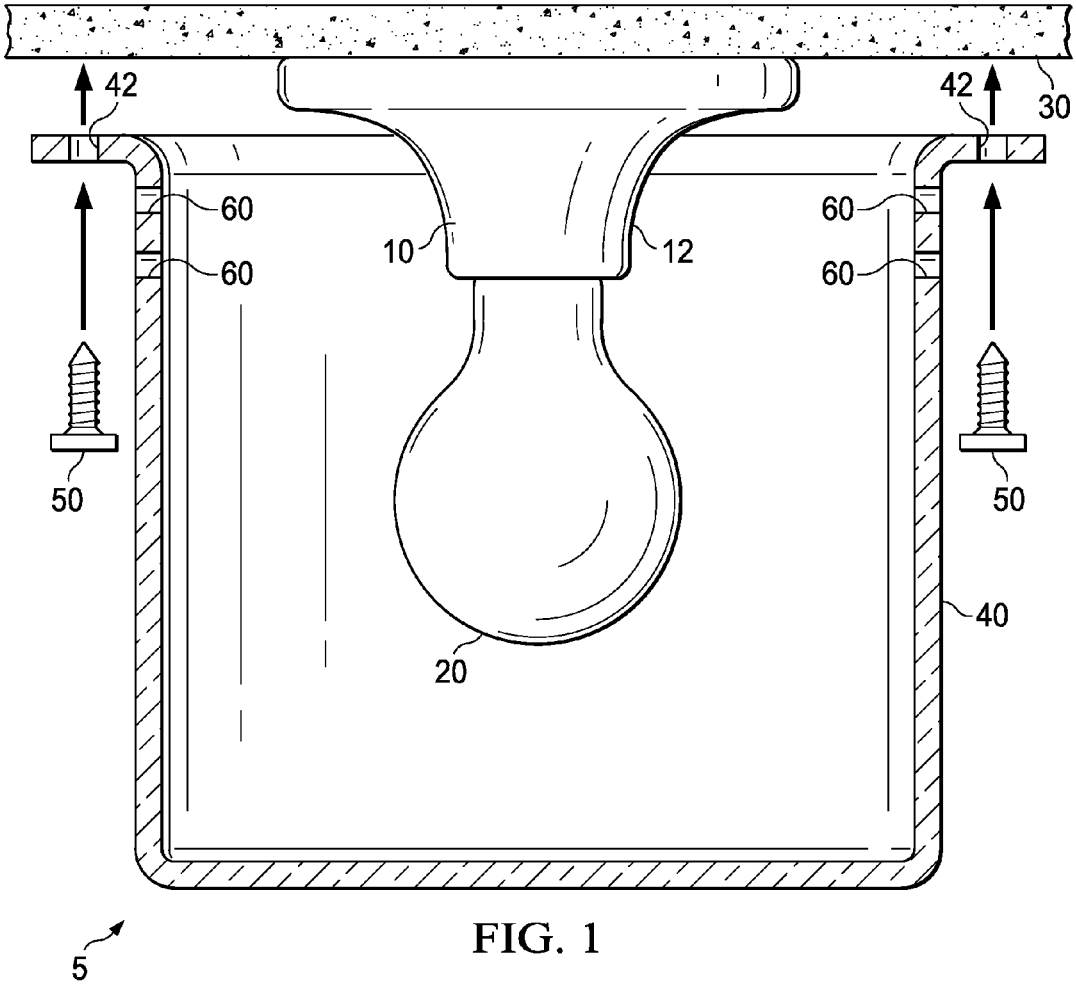
FIG. 1 illustrates installation of an exemplary protective light cover over an open bulb fixture, wherein the light cover is directly affixed to an exemplary wall or ceiling surface, in accordance with the present disclosure.

Referring now to the drawings, wherein the showings are for the purpose of illustrating certain exemplary embodiments only and not for the purpose of limiting the same, FIG. 1 illustrates installation of an exemplary protective light cover over an open bulb fixture, wherein the light cover is directly affixed to an exemplary wall or ceiling surface. Configuration 5 is illustrated including open bulb fixture 10, light bulb 20, and light cover 40. Open bulb fixture 10 is a lighting fixture without features to attach a light cover to protect an attached light bulb. In one embodiment, an open bulb fixture or open bulb lighting fixture can include a lighting fixture presenting an open air light bulb or a light bulb exposed unprotected to the area surrounding the bulb. In another embodiment, an open bulb fixture can include a cone shaped light shade partially shielding an open air light bulb. Open bulb fixture 10 can be made of ceramic, polymer, or any other material known in the art for constructing a light fixture. Open bulb fixture 10 is affixed to structure surface 30, which can be either a wall surface or a ceiling surface, and open bulb fixture 10 includes neck portion 12. Within neck portion 12, the open bulb fixture 10 includes a socket interface with features configured to accept a light bulb. Open bulb fixture 10 can be configured with a switch to control power flow to light bulb 20, such as by toggled activation of a pull chain, or power to the open bulb fixture can be controlled externally, for example, through a wall mounted light switch connected to the wiring system of the structure. Surface 30 can be an interior or exterior surface of a building. Absent light cover 40, light bulb 20 is exposed to the environment around the light bulb.

Light bulbs can be made of glass. Some types of light bulbs include chemicals that should not be exposed to the inhabitants of the room or area. A light bulb 20 within an open bulb fixture absent a light cover 40 is prone to breaking or damage. Further, building codes for a city or community can require that all light bulbs be covered. Building codes change over time. A home or building may have exposed light bulbs in open bulb fixtures that were acceptable when the building was purchased, for example, to light closet spaces, but in the ensuing period, local authority may have tightened building code requirements. Covered bulb fixtures are available to replace an open bulb fixture. A professional electrician can be hired to remove the open bulb fixtures and replace each with a new covered bulb fixture. Such a replacement process can be costly and time consuming. Covered bulb fixtures are readily available in retail hardware stores, but an untrained individual replacing his or her own open bulb fixtures can be problematic. The power to the fixture must be disconnected. The open light fixture must be removed from the structure surface. The wires connecting the fixture to a wiring system of the building must be handled carefully and properly reattached to the new fixture. The new covered bulb fixture must be properly reattached to the structure surface. An untrained individual faces a number of perils in replacing an open bulb fixture without professional assistance.

Light cover 40 of FIG. 1 is illustrated as a device that can be positioned to the open bulb fixture 10 and light bulb 20 to protect light bulb 20 from impact or mechanical stress. By installing light cover 40, the resulting covered light bulb can meet a building code requirement without the expense or risk associated with replacing open bulb fixture 10.

Exemplary screws 50 are illustrated to connect light cover 40 to structure surface 30. Holes 42 are illustrated in light cover 40 to retain the light cover with the screws. Holes 42 can be replaced with slots configured to release the light cover from screws 50 by rotating the light cover 40 by methods known in the art. Similarly, a flat plastic ring can be positioned between the structure surface 30 and light cover 40, with screws 50 fastening the ring to the surface 30 and features on the ring securing the light cover 40. Use of such an intervening plastic ring is commonly known for attaching retail available smoke detectors to a wall or ceiling. In another embodiment, an intervening plastic ring can be fitted with threading, and matching threading can be included upon light cover 40, such that the plastic ring can be affixed to the structure surface 30, and the light cover can be screwed upon the plastic ring. Similarly an adhesive can be used to securely attach light cover 40 the surface 30, and light cover 40 can be configured to open or include a two piece design to permit replacement of the light bulb 20 as needed. Similarly, a loop and hook fabric connection strip or mating magnetic tabs can be used to affix the light cover 40 to surface 30. The light cover 40 and/or the attachment method affixing the light cover to surface 30 should include some structure or configuration enabling easy replacement of light bulb 20. Attachment of light cover 40 to surface 30 with screws 50 is exemplary, and the disclosure is not intended to be limited to the particular exemplary attachment methods provided herein.

Light bulbs, when in use, can generate heat. Light fixtures fully or partially enclosing a light bulb can include heat management holes to permit air to flow around the light bulb, thereby reducing temperatures generated near the light bulb. Light cover 40 is illustrated with heat management holes 60 to permit a flow of air into and out of light cover 40. Additional holes can be placed toward the bottom of light cover 40 to permit increased flow of air through the light cover. Configurations, placements, and sizes of holes in light cover 40 can be selected based upon anticipated heat generation within the light cover. A number of different hole or air port configurations are envisioned to permit a flow of air through the light cover, and the disclosure is not intended to be limited to the particular exemplary embodiments provided herein.

Light covers can be made of a number of different materials. A material must be capable of withstanding temperatures common to the light fixture. Selection and configuration of hole patterns in the light cover can aid in heat management within the light cover according to methods known in the art. Light covers can be made of glass, a polymer, or any other transparent or translucent material permitting light from the enclosed light bulb to reach surrounding areas. Light covers can include decorative patterns, ribs reinforcing the strength of the light cover, prism shapes to diffuse light, color filters to control light emitted from the light cover, or other properties or structures known for light covers in the art.

An open bulb fixture can be retrofitted with a light cover, the cover encapsulating the entire open bulb fixture in order to protect the light bulb. In another embodiment, a cover or an assembly providing a cover can be retrofitted to the open bulb fixture. Such a light cover assembly can be affixed to the open bulb fixture, for example, attached to a neck of the fixture. In another embodiment, a light cover assembly can include an electronic device configured to attach to the socket interface of the open bulb fixture, and the light cover assembly can further include a second socket interface configured to receive a light bulb, with electrical power being transferred through the electronic device and the second socket interface to the light bulb. In one embodiment, the electronic device can be a socket extender.

Figure 2:
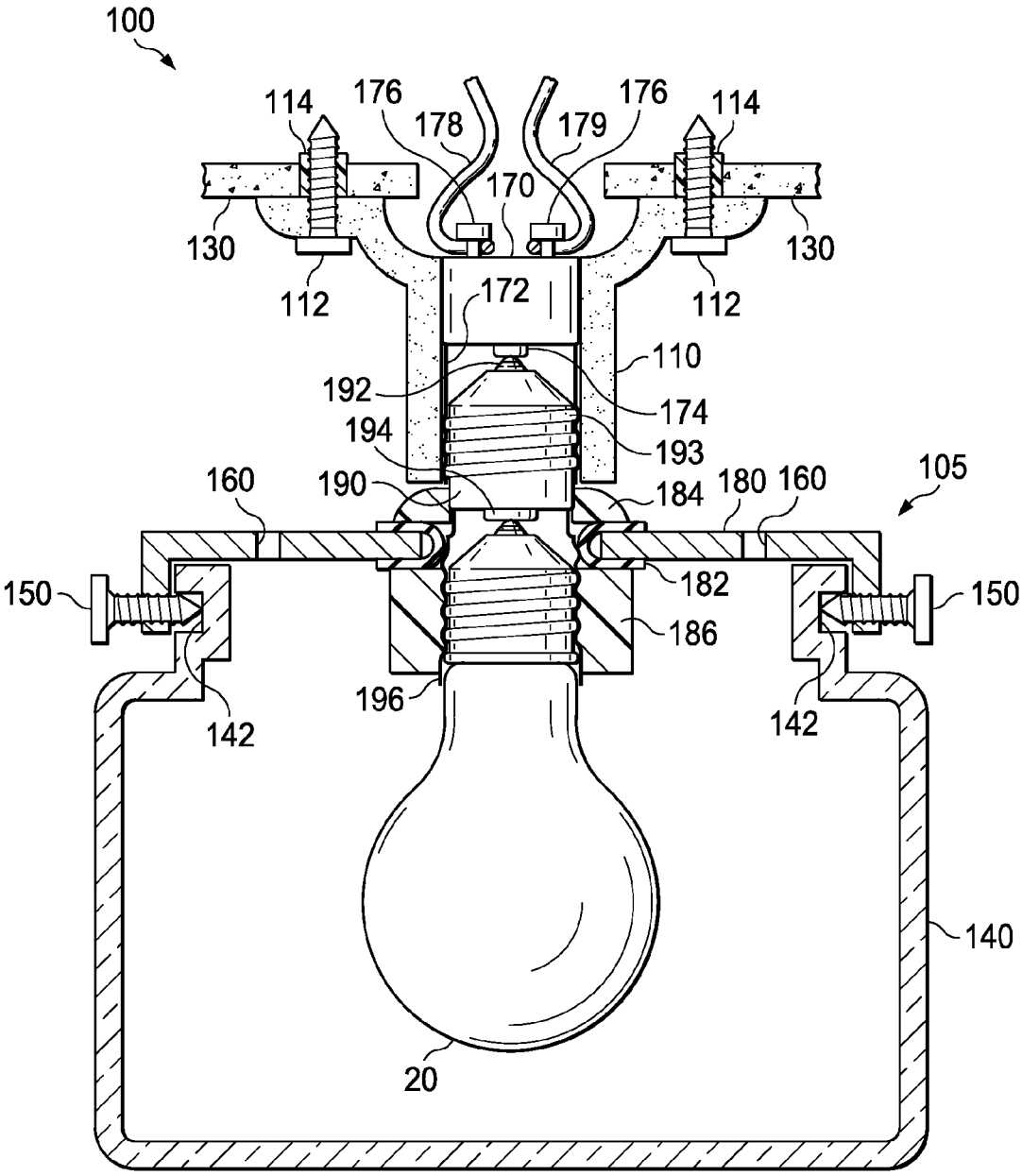
FIG. 2 illustrates an exemplary open bulb fixture retrofitted with an exemplary covered light socket assembly, in accordance with the present disclosure.

FIG. 2 illustrates in cross section an exemplary open bulb fixture retrofitted with an exemplary covered light socket assembly. Configuration 100 includes open bulb fixture 110, light bulb 20, and covered light socket assembly 105. Open bulb fixture 110 includes socket interface 170 and is affixed to structure surface 130 with screws 112. Surface 130 includes a wall anchor device 114 for each of screws 112. Socket interface 170 includes connection screws 176 fastening and electrically connecting each of a hot fixture wire 178 and a neutral wire 179 to socket interface 170. Socket interface 170 also includes hot tab 174, electrically connected to hot fixture wire 178, and neutral housing 172, electrically connected to neutral wire 179. Neutral housing 172 is configured with female threading to receive a male threaded portion of a light bulb 20. In another exemplary configuration, a pair of electrode openings could be provided on socket interface 170 to receive a similarly configured light bulb. The configuration of socket interface 170 is exemplary, and the disclosure is not intended to be limited to the particular exemplary embodiments provided herein.

Exemplary covered light socket assembly 105 includes a socket extender 190, a light cover flange 180, and a light cover 140. Socket extender 190 includes a male threaded portion 193 configured to match the female threading of neutral housing 172, such that covered light socket assembly 105 can be screwed into and make an electrical connection with socket interface 170. Threaded portion 193 includes a conductive surface or electrode such that a connection is made to neutral housing 172. A tip of socket extender 190 includes a hot electrode 192 configured to connect with hot tab 174. Socket extender 190 also includes a socket interface to engage with light bulb 20. The socket interface of extender 190 can be of a same type and for a same type of light bulb as socket interface 170. In the alternative, the socket interface of extender 190 can change a type of light bulb that can be used by configuration 100. Voltages and current flow of the light bulb for use with configuration 100 can match the specifications of the light bulb for use with socket interface 170. In the alternative, a number of changes to the electrical power provided to the light bulb can be implemented within socket extender 190 according to methods known in the art. Exemplary socket extender 190 includes a neutral housing 196 with female threading to accept light bulb 20 and a hot tab 194.

Socket extender 190 is connected to a light cover flange 180. Light cover flange 180 can be made of metal, polymer, ceramic, or any appropriate material with sufficient strength and heat resistance for use in lighting devices. Light cover flange 180 can include a mechanism for holding a light cover 140 to enclose light bulb 20. Exemplary light cover flange is illustrated including a plurality of set screws 150 configured to engage light cover 140 upon a set screw accepting feature 142. In one exemplary configuration, both light cover flange 180 and light cover 140 are round in a plane perpendicular to FIG. 2, such that feature 142 is an annular groove around the light cover 140. However, a number of shapes for flange 180 and light cover 140 are envisioned, and the disclosure is not intended to be limited to the particular examples provided herein.

Light cover flange 180 can be attached to socket extender 190 with exemplary ring-shaped retention features 184 and 186. In one exemplary configuration, retention feature 184 is glued or otherwise permanently affixed to extender 190, while feature 186 has threaded features to match threaded features upon neutral housing 196. By engaging and tightening feature 186, light cover flange 180 can be firmly affixed to extender 190. Retention features 184 and 186 are examples of how a light cover flange may be secured to a socket extender, however a number of different methods to secure the flange to the socket extender are envisioned and the disclosure is not intended to be limited to the particular examples provided herein. According to one embodiment wherein light cover flange 180 is made of electrically conductive material, an insulator 182 can be used between light cover flange 180 and socket extender 190. Light cover flange 180 can include a plurality of heat management holes 160 to permit air flow into and out of the light cover 140.

Figure 3:
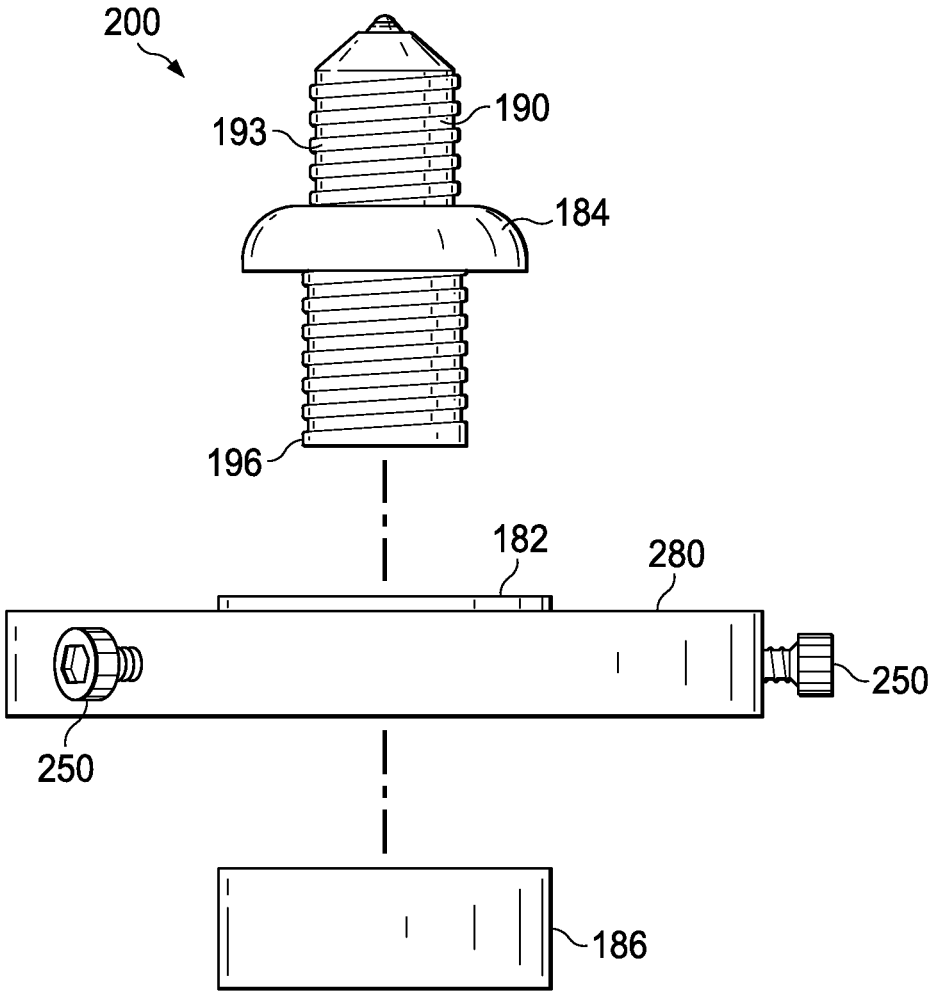
FIG. 3 illustrates exemplary components of a covered light socket assembly, including a socket extender and a light cover flange, in accordance with the present disclosure.

FIG. 3 illustrates exemplary components of a covered light socket assembly, including a socket extender and a light cover flange. Assembly 200 includes socket extender 190, light cover flange 280, and retention feature 186. Socket extender 190 includes a narrow male threaded portion 193 including a hot electrode configured to connect to a socket interface. Socket extender 190 further includes a wider threaded neutral housing 196 acting as a female portion or socket interface for a light bulb. Socket extender 190 is configured to transmit electrical power between the hot electrode and a hot tab located within the socket interface of the extender, and the extender is configured to transmit power between threads of the threaded male portion 193 and the neutral housing 196. In the illustrated embodiment, retention feature 184 is permanently affixed to the socket extender 190. Light cover flange 280 is illustrated including insulator 182 and set screws 250. Flange 280 and insulator 182 include a hole through which the neutral housing 196 can be inserted, such that a flat portion of retention feature 184 is flat against insulator 182 and the neutral housing 196 extends to a bottom side of flange 280. The neutral housing 196 can be constructed of a metal of substantially constant thickness, such that the neutral housing includes threads upon both the inside surface of the neutral housing and the outside surface of the neutral housing. Retention feature 186 is configured with threading on an inner diameter, such that feature 186 can be screwed upon neutral housing 196. By screwing feature 186 upon neutral housing 196 until the feature 186 contacts and compresses insulator 182, light cover flange 280 can be affixed to socket extender 190. Set screws 250 are illustrated, configured to a flange 280 with three set screws 250 equally spaced around a diameter of cover flange 280.

Figure 4:
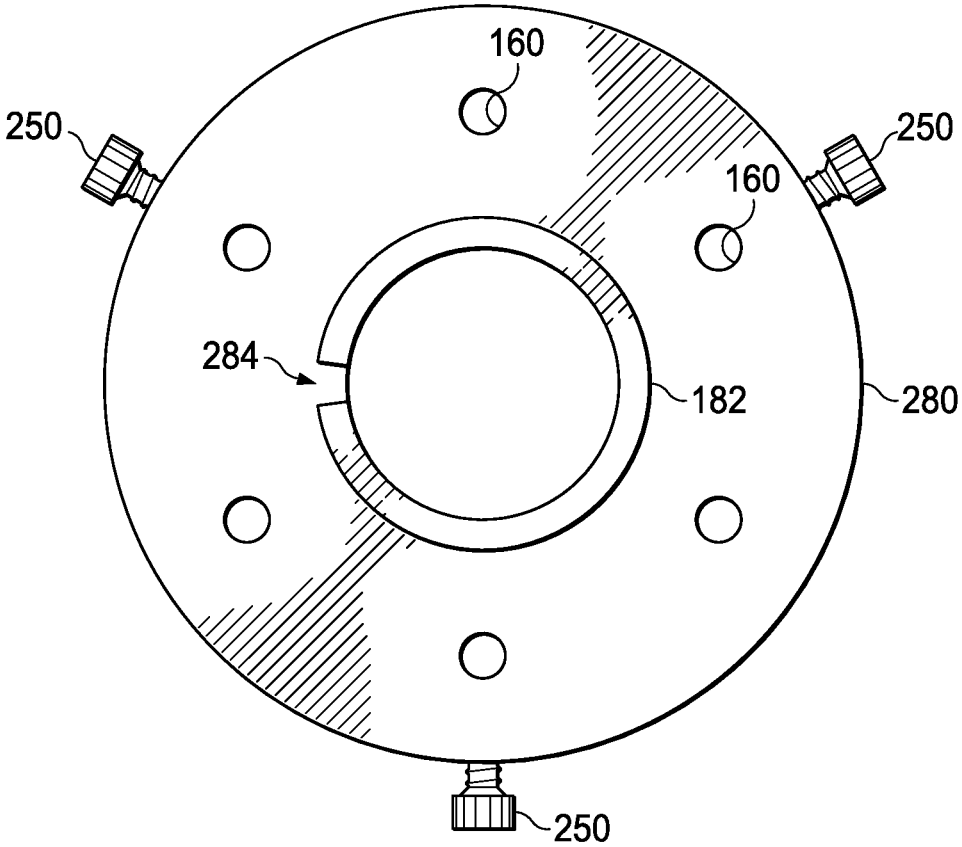
FIG. 4 illustrates an exemplary light cover flange including an exemplary flange insulator positioned to the flange, in accordance with the present disclosure.

FIG. 4 illustrates an exemplary light cover flange including an exemplary flange insulator positioned to the flange. Three exemplary set screws 250 are illustrated spaced equally around a diameter of flange 280. Insulator 182 is illustrated assembled to an inner diameter of flange 280. Insulator 182 is an optional construction, in particular for use when flange 280 is constructed of an electrically conductive material. Insulator 182 can include any structure, wrap, coating, or barrier capable of insulating flange 280 from a metal portion of a socket extender capable of transmitting electrical power. The exemplary insulator 182 includes a flexible polymer material with a U-shaped cross section, such that the flange 280 can be inserted within the U-shape. The insulator can include a gap 284 when installed to the flange 280, so long as the gap does not permit the flange 280 to come into contact with a surface of a socket extender. Flange 280 includes six exemplary holes 160 for managing heat within the light cover assembly.

Figure 5:
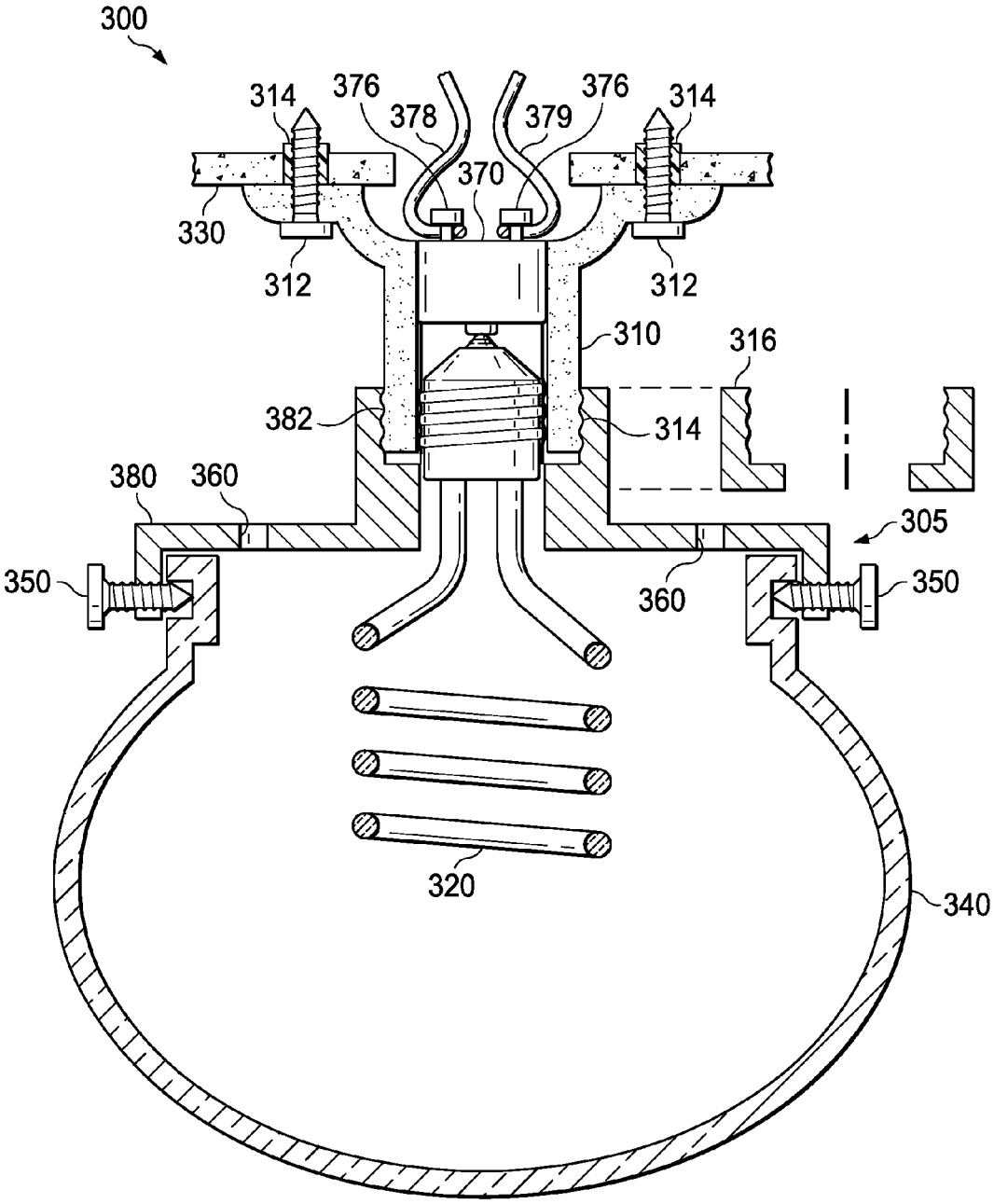
FIG. 5 illustrates an exemplary open bulb fixture, originally configured with a threaded socket end ring, retrofitted with an exemplary covered light socket assembly including a fixture engagement section with threading to match the threading of the open bulb fixture, in accordance with the present disclosure.

A light cover assembly can be affixed to an open bulb fixture according to a number of envisioned embodiments. Some open bulb fixtures include features that can be utilized to affix the light cover assembly. Some open bulb fixtures are made of a polymer material and include threading to attach an end ring at the end of the neck of the fixture. The end ring can function to retain the end of a socket interface within the fixture and prevent the socket interface from being stressed or pulled toward the end of the neck of the fixture. The threading used to affix the end ring can be utilized to affix a light cover assembly to the open bulb fixture. FIG. 5 illustrates an exemplary open bulb fixture, originally configured with a threaded socket end ring, retrofitted with an exemplary light cover assembly including a fixture engagement section with threading to match the threading of the open bulb fixture. Assembly 300 includes open bulb fixture 310 and light cover assembly 305. Open bulb fixture 310 originally included an end ring 316 configured to secure socket interface 370 within open bulb fixture 310. Socket interface 370 is illustrated connected to hot fixture wire 378 and neutral wire 379 through connecting screws 376. A ground wire can additionally be connected. Open bulb fixture 310 includes threading 314 configured to accept matching threading upon an inner diameter of end ring 316. End ring 316, originally utilized with open bulb fixture 310 to retain socket interface 370, is illustrated removed from open bulb fixture 310. End ring 316 can be discarded after the installation of light cover assembly 305. Light cover assembly 305 includes light cover flange 380 and light cover 340. Light cover flange 380 includes threading 382 configured to affix to threading 314, holes 360 for heat management, and set screws 350. Light cover flange 380 is illustrated screwed onto open bulb fixture 310. Once light cover flange 380 is installed to open bulb fixture 310, light cover 340 can be removed and replaced to install or replace a light bulb to socket interface 370. A high efficiency fluorescent or compact fluorescent lamp 320 is illustrated installed to socket interface 370.

Figure 6:
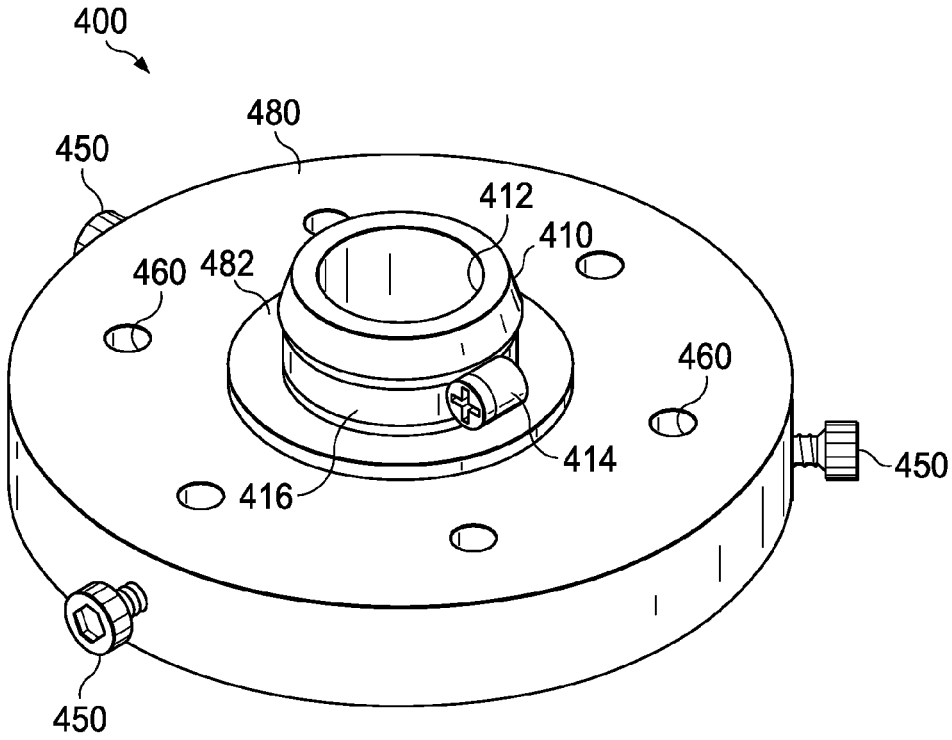
FIG. 6 illustrates an exemplary light cover flange including an elastic fixture engagement section and a constriction band device positioned to fasten the elastic fixture engagement section to a neck portion of an open bulb fixture, in accordance with the present disclosure.

Other embodiments with other methods to affix a light cover assembly to an open bulb fixture are envisioned. Open bulb fixtures can include a neck section with a cylindrical or tapered profile. A light cover flange can be utilized to grip to the neck section. FIG. 6 illustrates an exemplary light cover flange including an elastic fixture engagement section and a constriction band device positioned to fasten the elastic fixture engagement section to a neck portion of an open bulb fixture. Configuration 400 includes light cover flange 480 including elastic fixture engagement section 410. Light cover flange is illustrated with set screws 450 and holes 460 for heat management. Elastic fixture engagement section 410 can be made of a rubber or other polymer selected to permit a neck section of an open bulb fixture to be inserted into opening 412, with the elastic properties of the elastic fixture engagement section 410 permitting an interference fit between section 410 and the neck section and permitting a strong frictional forces retaining section 410 to the open bulb fixture. Further, a clamping force can be applied to the elastic fixture engagement section 410 to increase retention of light cover flange 480 to the open bulb fixture. Constriction band device 416 is illustrated located to elastic fixture engagement section 410 with adjustment mechanism 414 configured to tighten constriction band device 416 and increase a frictional force between elastic fixture engagement section 410 and the neck section of the open bulb fixture. According to one exemplary embodiment, adjustment mechanism 414 can include a screw pattern configured to engage a series of features upon constriction band device 416, such that turning an input interface of adjustment mechanism 414 turns the screw pattern, and the turning screw pattern increasingly engages and pulls upon the features upon constriction band device 416. Elastic fixture engagement section 410 can include a U-shaped flange engagement section 482 configured to grip to the flat surface of light cover flange 480, with the flat section of flange 480 inserting into the U-shape similarly to flange 280 of FIG. 4 fitting within insulator 182. Flange engagement section 482 must be configured with sufficient rigidity and strength to hold the weight of the light cover assembly.

Figure 7:
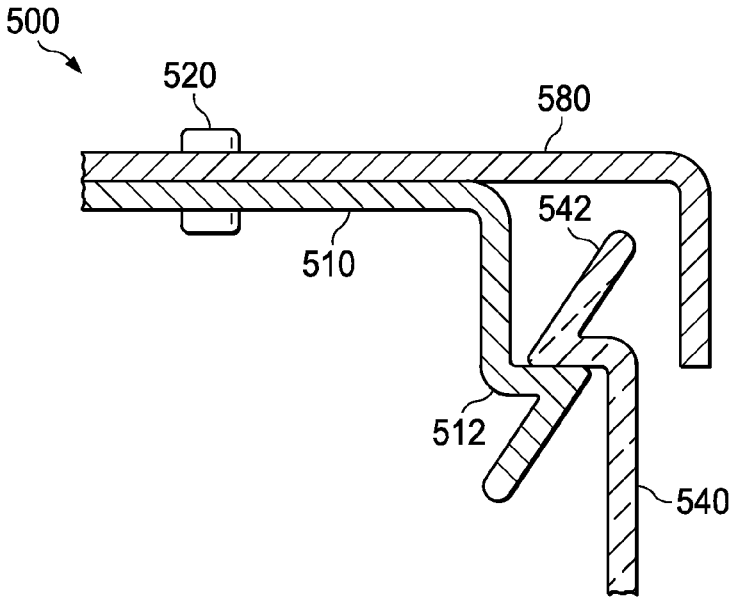
FIG. 7 illustrates an exemplary snap fit configuration to retain a light cover to a light cover flange, in accordance with the present disclosure.

Set screws can be used to attach a light cover to a light cover flange. Other methods are envisioned to affix the light cover to the light cover flange. FIG. 7 illustrates an exemplary snap fit configuration to retain a light cover to a light cover flange. Light cover flange 580 is illustrated with a snap-fit retention feature 512 attached to flange 580 with rivet 520. Snap-fit retention feature 512 includes a spring arm 510, such that snap-fit retention feature 512 can flex to accept mating features 542 upon light cover 540. Features 512 and 542 are configured with angled surfaces such that light cover 540 can be easily installed to light cover flange 580, and features 512 and 542 are configured such that light cover 540 can be securely held in place and such that application of force significantly in excess of the weight of light cover 540 can be applied to disengage light cover 540 from flange 580. A number of methods and configurations to attach a light cover to a flange are envisioned, and the disclosure is not intended to be limited to the particular examples provided herein.

Figure 8:
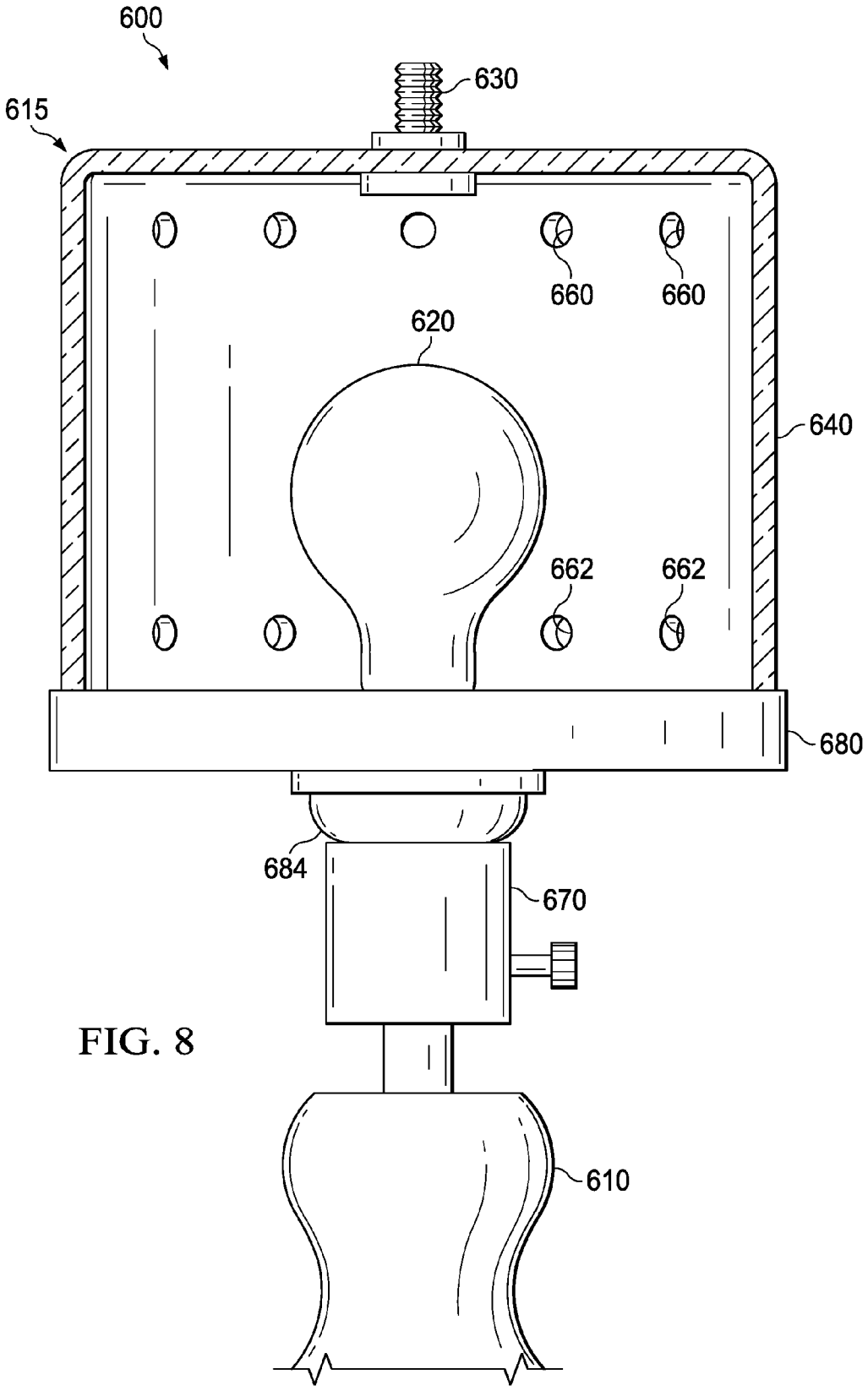
FIG. 8 illustrates an exemplary table lamp including an open bulb fixture retrofitted with an exemplary covered light socket assembly, in accordance with the present disclosure.

Table lamps and floor lamps include an open bulb that may or may not be partially protected, for example, by a lamp shade or cone shaped protective shield. However, the light bulb is still exposed to the environment around the bulb. A lamp in an area with heavy usage, playing children, or otherwise unpredictable conditions can be exposed to increased risk of the lamp being knocked over or of an object impacting the light bulb. A light cover can be installed to a lamp according to methods disclosed herein to protect the light bulb from damage. FIG. 8 illustrates an exemplary table lamp including an open bulb fixture retrofitted with an exemplary covered light socket assembly. Configuration 600 includes table lamp body 610, light switch assembly 670, and covered light socket assembly 615. Similar to assembly 105 of FIG. 2, covered light socket assembly 615 includes light cover 640, light cover flange 680, retention feature 684, and light bulb 620. Covered light socket assembly 615 includes a socket extender, enabling covered light socket assembly 615 to attach to a socket interface of light switch assembly 670. Covered light socket assembly 615 further includes lamp shade stud 630 attached to a top of light cover 640. Lamp shade stud 630 is configured to receive a lamp shade upon the top of the lamp, in accordance with known table lamp configurations. Lamp shade stud 630 includes threading to receive a lamp shade nut known in the art for securing the lamp shade to the stud.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. Apparatus to provide electrically powered light for a building structure, comprising:

an open bulb fixture mounted to a structure surface comprising one of a wall surface and a ceiling surface and receiving electrical power from an electrical system of the structure, the open bulb fixture comprising:

a fixture housing; and a socket interface configured to receive a light bulb; and a light cover assembly affixed to the open bulb fixture, the light cover assembly comprising a light cover;

wherein the light cover assembly comprises a covered light socket assembly;

wherein the covered light socket assembly comprises:

a socket extender comprising a male portion configured to engage with the socket interface and a female portion configured to receive a light bulb; and a light cover flange affixed to the socket extender and securing the light cover; and wherein the light cover flange comprises a plurality of heat management holes.

2. Apparatus to provide electrically powered light for a building structure, comprising:

an open bulb fixture mounted to a structure surface comprising one of a wall surface and a ceiling surface and receiving electrical power from an electrical system of the structure, the open bulb fixture comprising:

a fixture housing; and a socket interface configured to receive a light bulb; and a light cover assembly affixed to the open bulb fixture, the light cover assembly comprising a light cover;

wherein the light cover assembly comprises a covered light socket assembly;

wherein the covered light socket assembly comprises:

a socket extender comprising a male portion configured to engage with the socket interface and a female portion configured to receive a light bulb; and a light cover flange affixed to the socket extender and securing the light cover; and wherein the covered light socket assembly further comprises an insulator between the light cover flange and the socket extender.

3. An apparatus to provide electrically powered light, comprising:

a lamp device comprising:

an open bulb fixture comprising a socket interface configured to receive a light bulb; and a covered light socket assembly comprising a light cover located to the open bulb fixture; and wherein the covered socket assembly comprises:

a socket extender comprising a male portion configured to engage with the socket interface and a female portion configured to receive a light bulb;

a light cover flange affixed to the socket extender and securing the light cover; and a lamp shade stud connected to the light cover.

* * * * *